US007520341B1

(12) United States Patent
DeVall

(10) Patent No.: US 7,520,341 B1
(45) Date of Patent: Apr. 21, 2009

(54) DRILL HEAD ASSEMBLY

(76) Inventor: Donald L. DeVall, 1082 Charles Ave., Morgantown, WV (US) 26505

( * ) Notice: Subject to any disclaimer, the term of this patent is extended or adjusted under 35 U.S.C. 154(b) by 0 days.

(21) Appl. No.: 11/904,172

(22) Filed: Sep. 26, 2007

(51) Int. Cl.
*E21B 31/00* (2006.01)

(52) U.S. Cl. ..... 175/57; 175/320; 279/4.09

(58) Field of Classification Search ..... 175/57, 175/320; 279/4.07, 4.08, 4.09, 43, 50
See application file for complete search history.

(56) References Cited

U.S. PATENT DOCUMENTS

| | | | | |
|---|---|---|---|---|
| 3,451,314 | A * | 6/1969 | Smrekar | 91/422 |
| 3,493,238 | A * | 2/1970 | Ludwig | 279/4.04 |
| 3,835,649 | A * | 9/1974 | Le Testu | 60/560 |
| 3,990,522 | A | 11/1976 | Pyles | 173/78 |
| 4,032,162 | A * | 6/1977 | Flinchbaugh | 279/4.09 |
| 4,190,116 | A | 2/1980 | O'Neal et al. | 173/38 |
| 4,294,317 | A | 10/1981 | Amoroso | 173/57 |
| 4,413,930 | A | 11/1983 | Calandra, Jr. | 405/261 |
| 5,195,598 | A | 3/1993 | DeVall | 173/197 |
| 5,330,013 | A | 7/1994 | Sollami | 173/216 |
| 5,492,183 | A | 2/1996 | Sollami | 173/216 |
| 5,690,183 | A | 11/1997 | Sollami | 173/216 |
| 5,954,346 | A | 9/1999 | McLaren | 279/4.12 |
| 6,109,366 | A | 8/2000 | Jansson et al. | 173/216 |
| 6,695,071 | B1 | 2/2004 | DeVall | 173/1 |
| 6,698,533 | B2 | 3/2004 | Lindback | 173/213 |
| 6,712,157 | B2 | 3/2004 | Hansson | 173/216 |
| 6,871,711 | B2 | 3/2005 | Hansson | 173/216 |
| 7,025,538 | B2 | 4/2006 | Ludwig et al. | 405/259.5 |
| 7,033,117 | B2 | 4/2006 | Ludwig et al. | 405/259.5 |

OTHER PUBLICATIONS

"The OneStep system: simple, fail-safe, easily adaptable", Hilti product literature, 2004.

* cited by examiner

*Primary Examiner*—William P Neuder
(74) *Attorney, Agent, or Firm*—Price & Adams

(57) ABSTRACT

A drill housing rotatably supports a shaft having an internal cavity for receiving a drilling device, such as a drill steel, bolt driver, and rock anchor adaptor. The upper end of the housing is closed by a cover plate and a flinger having an opening for receiving pressurized fluid and a passageway for transporting the pressurized fluid into the shaft. The pressurized fluid axially displaces a collet mounted within the shaft against the bias of a spring to frictionally engage the drilling device to transmit rotation thereto.

23 Claims, 5 Drawing Sheets

DRILL HEAD ASSEMBLY

BACKGROUND OF THE INVENTION

1. Field of the Invention

This invention relates to method and apparatus for holding a drilling device in a drill head assembly and, more particularly, to method and apparatus for gripping and engaging a tubular member that has been inserted into the drill head assembly.

2. Description of the Related Art

Drilling devices, such as drill steels, bolt drivers, water distributors, adaptors, and other similar tools, are commonly used in rock drilling operations. It is a conventionally known practice to drill holes in a rock formation by a rotary drill assembly or by a rotary percussion drill assembly. These assemblies include a drill pot that carries a hydraulic motor having a motor shaft rotatably connected to a bevel gear which meshes with another bevel gear rotatably journaled on a support member or hub within the drill housing. The bevel gear is affixed to a rotatable head or cover, which has a seat into which the shank of a drilling device or drill steel is received. A drill bit is positioned on the upper end of the drill steel. With this arrangement, rotation of the motor shaft is transmitted to the drill steel to rotate the drilling device.

A common problem with drill assemblies and other power tools involves obtaining adequate lubrication. Many examples of power tools having improved methods and apparatus for improving lubrication are known in the art. U.S. Pat. Nos. 6,712,157 and 6,871,711 disclose improved power tools having a gear chamber with lubricating grease. The gear chamber is provided with a grease screen that is arranged in close vicinity to the teeth of a bevel gear. The gear chamber covers a substantial part of the teeth to prevent lubricating grease from getting into contact with the bevel gear teeth, which causes viscous friction by the angle drives during tool operation. The gear chamber also includes a grease relocating element that is movably guided along substantially circular paths in housings. The paths are concentrically located with bevel gears and coupling devices.

U.S. Pat. No. 6,109,366 discloses a power tool having a lubricant dispensing device with a receptacle immovably supported in a gear casing. The tool also includes a peripheral side wall and an end wall. The end wall is formed with a through opening for an output shaft and an outlet opening for the lubricant. An agitator element is freely movable within a receptacle for agitating the lubricant by vibratory movements during operation of the tool to facilitate the spreading of the lubricant toward the outlet opening.

U.S. Pat. No. 6,698,533 discloses a powered grinding tool. The tool includes a housing having an angle drive chamber enclosing an angle drive section. The chamber is partially filled with lubricating grease. A rotating drive pinion displaces grease off of gear teeth and deposits the grease along a chamber wall.

Another common problem with drill assemblies relates to the positioning of the drill assembly. Generally, the drill assembly is carried by a self-propelled machine that maneuvers the drill pot into position and in a direction to advance the drill bit into the rock formation. For rock drilling operations in an underground mine, the drill assembly is supported by a boom that is pivotally mounted on the front of a mobile frame. Upward movement of the boom moves the drill steel seated in a drill pot into drilling position. The boom exerts upward pressure on the drill assembly to increase the driving thrust of the drill steel. As a result, the drill steel advances vertically into the rock formation to dislodge rock materials and form an elongated bore in the rock formation to receive a mine roof bolt.

The upward force exerted upon the drill assembly by the boom overcomes resistance of the rock structure to rotation of the drill bit. Such conditions establish the need for drill assembly configurations that increase the amount of torque applied to the drill steel and decrease drill steel slippage. Dust is also a problem that causes deterioration of the gearing and bearings of drill assemblies. Therefore extensive seal arrangements are used on the drill head assemblies.

Many other examples of drill head assemblies and drill heads are known in the art. U.S. Pat. No. 4,294,317 discloses a rotary drill head that is part of a mine roof bolter. The drill head includes a shaft end portion having a deep interior passage adapted to receive the end of a hollow drill bit.

U.S. Pat. No. 5,195,598 discloses a typical drill head assembly for rock drill operations. The drill head assembly includes a rotary drill head having a cover with a flinger that can easily be removed from the drill head assembly. U.S. Pat. No. 3,990,552 discloses a drill head that is part of a rotary percussion drill. U.S. Pat. No. 4,190,116 discloses a rotary drill head that is part of a mine roof bolter.

U.S. Pat. Nos. 5,492,183 and 5,690,183 disclose a drill head unit with a drill chuck. The drill chuck includes a cylindrical central section with steel balls for holding a drill steel in place.

U.S. Pat. No. 5,954,346 discloses a hydraulic chuck having a hydraulic actuator for operating a jaw assembly. The jaw assembly has circumferentially disposed jaws adapted to engage a drill rod. The actuator remains stationary while a spindle rotates. A skirt is attached to the actuator to cover bearing assemblies. The jaws are supported in slots in the spindle. The chuck is secured to a drive unit by bolts received in open slots in an attachment flange to facilitate attachment of the chuck after routine maintenance.

U.S. Pat. Nos. 5,330,013 and 5,492,183 disclose a drill head unit with a drill chuck. The drill chuck includes a cylindrical central section with steel balls for holding a drill steel in place.

U.S. Pat. No. 6,695,071 discloses a drill head for holding a drill steel that includes a drill housing having an internal cavity defined by an upper opening and a lower portion with a lower opening. The internal cavity includes a pair of concentric axially aligned sleeves. An internal sleeve has an inner surface for receiving a drill steel and an outer tapered surface. An external sleeve has an internal tapered mating surface for receiving the internal sleeve. The drill head also includes a sliding member for receiving hydraulic pressure to move the internal sleeve on the tapered surface of the external sleeve into gripping engagement of the drill steel. A Belleville spring provides an opposing force to normally maintain the internal sleeve out of gripping engagement with the drill steel.

Drill assemblies are also used with rock anchors or bonding anchors. A conventional anchor is installed through a five-step process. The first step involves drilling a hole in a rock formation through the use of a conventional drill steel. The second step involves retracting a drill steel from the hole. The third step involves inserting an adhesive cartridge into the hole. The fourth step involves inserting the anchor into the hole. The fifth step involves setting the anchor within the hole.

U.S. Pat. No. 4,413,930 discloses a rock anchor assembly. The rock anchor assembly carries a roof support plate on the opposite end of a bolt. The assembly inserts an anchor into a rock formation. The assembly includes one or more resin cartridges. The cartridges rupture and release resin components for mixing. The assembly rotates the anchor in a preselected direction to mix the resin components before expanding a shell while the resin cures. The cured resin bonds a bolt and expanded shell to the rock formation to resist slippage of the expanded shell and maintain the bolt in tension.

U.S. Pat. No. 7,033,117 discloses a self-drilling rock anchor assembly that is utilized with a drilling assembly. The rock anchor assembly includes an anchor tube, a drill head, an outer thread, a free end and an adapter. The adapter releasably connects with the anchor tube. The adapter also has an inner thread for engaging the outer thread of the anchor tube, a screw stop, and a quick-intervention element. The quick-intervention element connects with a rotatable chuck of a drilling assembly the rock anchor is driven into a rock formation.

U.S. Pat. No. 7,025,538 discloses a rock anchor assembly for use with a drill assembly. The rock anchor assembly includes an anchor tube and an inner tube for holding a resin cartridge. The anchor tube has a drilling head and a trailing end. A drilling machine is coupled for rotary driving of the anchor at the trailing end. The anchor has a centering assembly with a pair of centering elements, which hold the inner tube both radially and axially aligned in the anchor tube.

Another rock anchor assembly, known as the OneStep™ by the Hilti Corporation within the Principality of Liechtenstein, includes an adaptor that allows the anchor to be installed through a two-step process. The first step involves drilling the hole. The second step involves injecting adhesive into the hole to hold the anchor in place.

During drilling operations, the clearance of a drill head assembly is a major concern. Conventional drill head assemblies that are used with the above-described rock anchors typically have a box height of between eight and nine inches (20.3 cm and 22.9 cm). Accordingly, there is a need for an improved drill head assembly that has a reduced height.

SUMMARY OF THE INVENTION

In accordance with the present invention there is provided a drill head assembly for holding a drilling device. A drill housing assembly has an upper portion and a lower portion with an internal cavity extending through the upper portion into the lower portion. The drill housing assembly upper portion has an opening for receiving pressurized fluid and a passageway for transporting the pressurized fluid. A sleeve has an internal surface for receiving the drilling device mounted for longitudinal and radial movement within the internal cavity. An impact member is positioned in contact with the sleeve and communicates with the drill housing assembly upper portion passageway. The drill housing assembly upper portion receives pressurized fluid to move the impact member to displace the sleeve in an axial direction so that the sleeve internal surface frictionally engages the drilling device.

Further in accordance with the present invention, there is provided a drill head assembly for holding a drilling device. The drill head assembly includes a housing. A shaft is rotatably supported within the housing and has an internal bore with an opening for receiving the drilling device at one end. Means rotatably connect and seal the shaft at the opposite end. A gripping assembly is mounted on the shaft adjacent to the opening. The gripping assembly has a gripping member axially positioned within the bore. An impact member engages the gripping member. Means is provided for supplying pressurized fluid to move the impact member to displace the gripping member in an axial direction to frictionally engage the drilling device within the shaft internal bore.

Further in accordance with the present invention, there is provided a method for gripping a drilling device. The drilling device is inserted into an axially mounted collet positioned for reciprocal movement in a shaft assembly internal bore. Pressurized fluid is injected into the shaft assembly to move a piston positioned adjacent to and in contact with the collet. The collet is moved in response to movement of the piston to displace the collet in longitudinal and radial directions within the shaft assembly internal bore. The drilling device nonrotatably engages the collet.

Accordingly, a principal object of the present invention is to provide drill head assembly having improved sealing means.

Another object of the present invention is to provide a drill head assembly having a gripping member that is actuated by pressurized grease.

A further object of the present invention is to provide a compact drill assembly having a reduced height.

A further object of the present invention is to provide a drill head assembly in which a piston drives a gripping member to move in an axial direction in response to the accumulation of pressurized fluid in an upper portion of the assembly.

These and other objects of the present invention will be more completely described and disclosed in the following specification, accompanying drawings, and appended claims.

DESCRIPTION OF THE PREFERRED EMBODIMENTS

Figure 1:
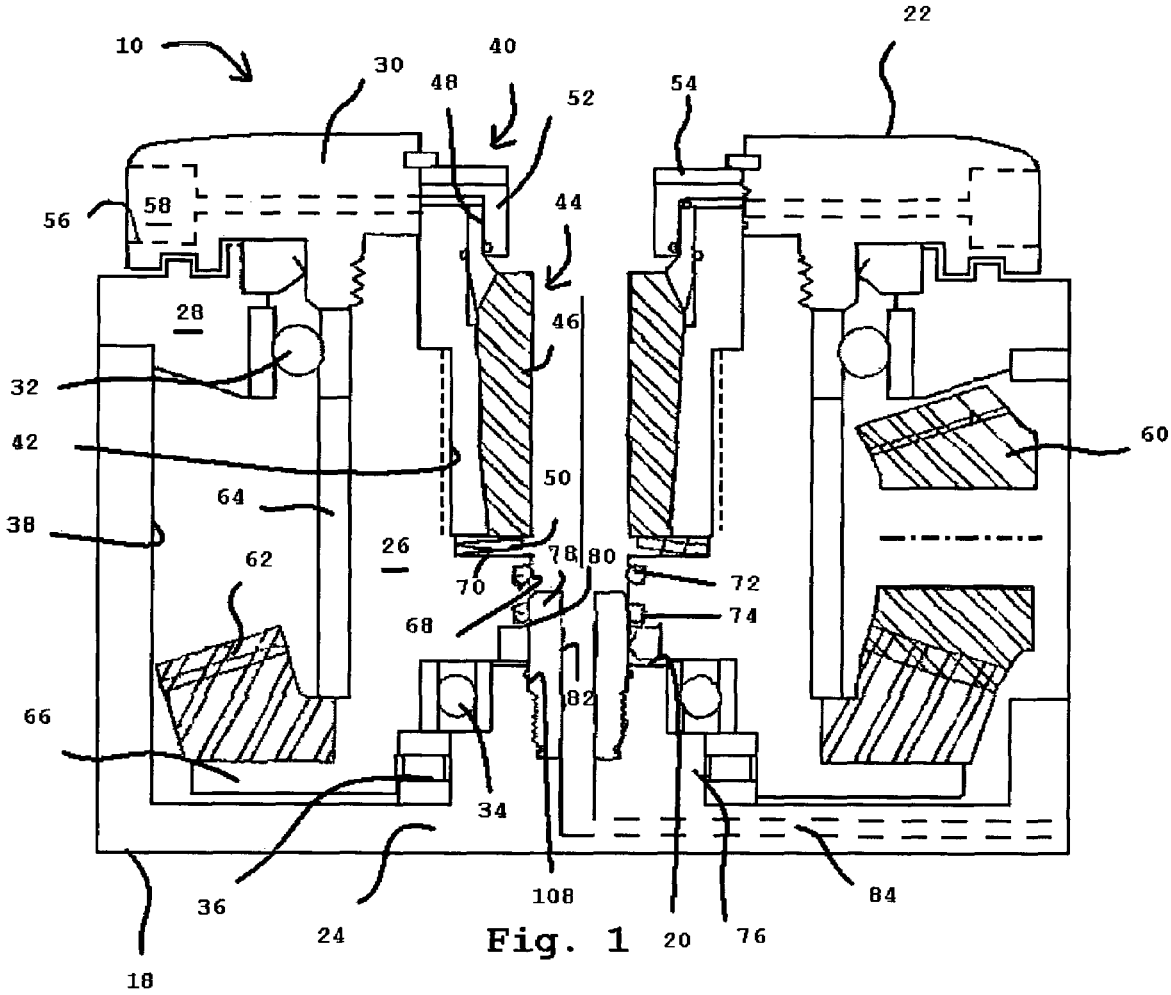
FIG. 1 is a sectional view in side elevation of the drill head assembly for gripping and holding a drilling device.
Figure 2:
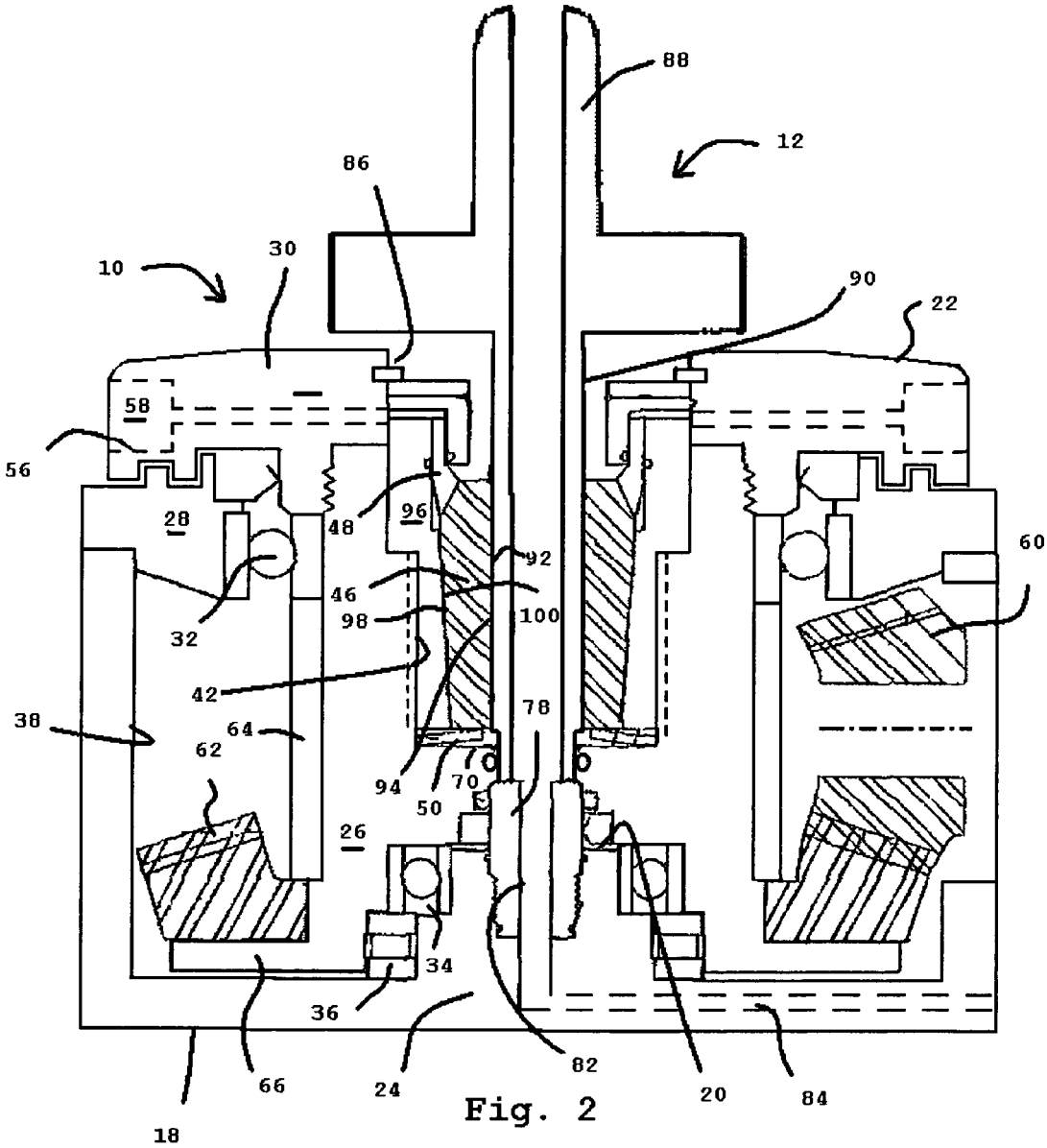
FIG. 2 is a sectional view in side elevation of the drill head assembly shown in FIG. 1 in combination with a drilling device.
Figure 3:
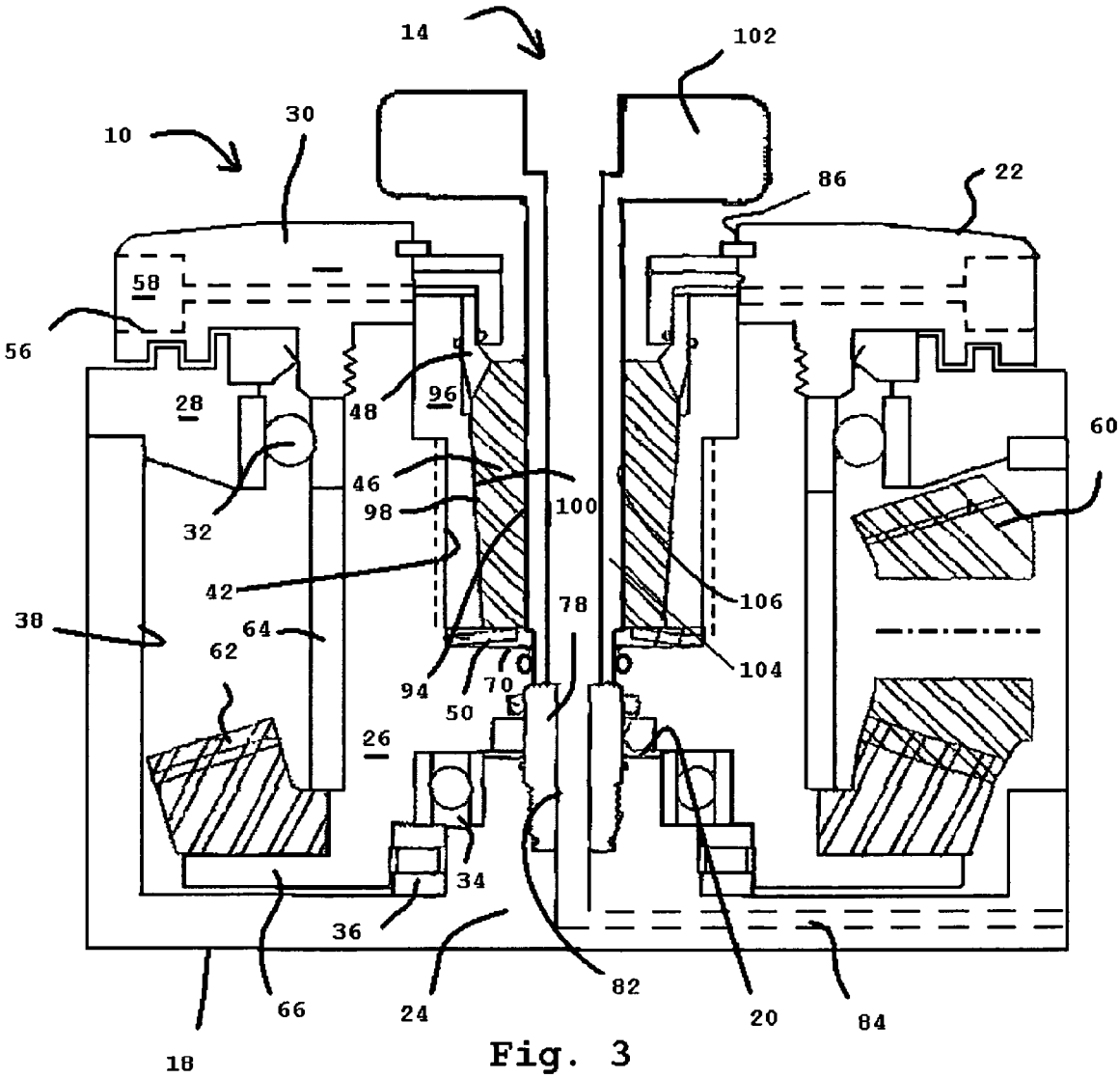
FIG. 3 is a sectional view in side elevation of the drill head assembly shown in FIG. 1 in combination with bolt driver.
Figure 4:
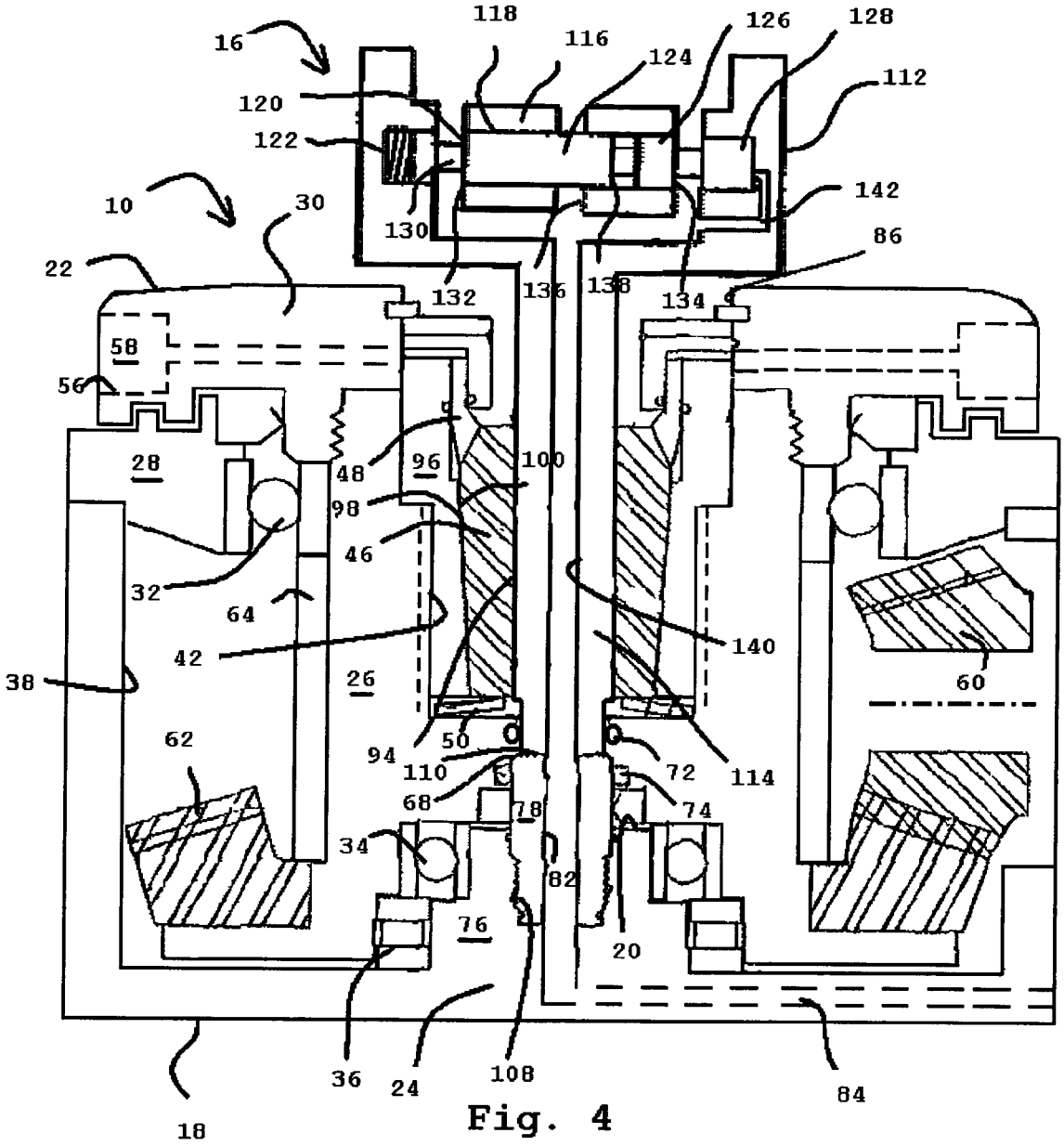
FIG. 4 is a sectional view in side elevation of the drill head assembly shown in FIG. 1 in combination with a water distributor illustrated in a closed position.

Referring to the drawings and, particularly, to FIGS. 1-4, there is illustrated an improved rotary drill assembly generally designated by the numeral 10 for holding various drilling devices 12, 14, 16, shown in FIGS. 2, 3, and 4 respectively. The drilling device 12 shown in FIG. 2 is a conventional cylindrical drill steel for performing rotary drilling operations in rock formations. The drilling device 14 shown in FIG. 3 is a conventional bolt driver for installing bolts in rock formations. The drilling device 16 shown in FIG. 4 is an adaptor or water distributor for connecting the drilling assembly 10 to a rock anchor (not shown). The rock anchor performs operations similar to the operations described in U.S. Pat. No. 4,413,930.

Referring now to FIG. 1, the drill head assembly 10 includes an external drill housing 18 having a lower portion 20 and an upper portion 22. The lower portion 20 includes a box 24 and a tubular shaft 26 rotatably mounted on the box 24. The upper portion 22 includes a cover plate 28 that closes the box 24 and a flinger 30 that covers the cover plate 28. The upper portion 22 also includes a bearing 32 positioned between the shaft 26 and the cover plate 28. The lower portion 20 includes a bearing 34 and a thrust bearing 36 positioned between the shaft 26 and the box 24.

The upper portion 22 defines an axially aligned internal cavity 38 that extends through an opening 40 in the flinger 30 into the lower portion 20. The cavity 38 includes an improved gripping assembly 40 positioned within an internal bore 42 of the shaft 26. The gripping assembly 40 is hydraulically actuated to frictionally engage the drilling devices 12, 14, 16 shown in FIGS. 2-4. The gripping assembly generally designated by the numeral 40 rotates along with the shaft 26 to rotate the drilling devices 12, 14, 16 relative to the box 24 to perform various drilling operations.

The gripping assembly 40 includes the flinger 30, a drill chuck generally designated by the numeral 44 with an axially aligned sleeve or collet 46, an impact member 48, a resilient member 50, and a plurality of spacers 52, 54 positioned within the internal cavity 38. The collet 46 is positioned between the resilient member 50 and the impact member 48 for longitudinal and radial movement between the lower portion 20 and the upper portion 22.

The collet 46 is positioned between the flinger 30 and the shaft 26. The upper end of the collet 46 contacts the impact member 48 so that the impact member 48 connects the collet 46 to the flinger 30. The lower end of the collet 46 contacts the resilient member 50 to connect to the shaft 26.

The flinger 30 is an annular ring that is threadedly connected to the shaft 26. The flinger 30 includes an internal lubrication system for providing pressurized fluid to the gripping assembly 40. The lubrication system includes an opening 56 for receiving pressurized fluid, preferably grease, and a passageway formed from an internal chamber 58. The opening 56 communicates with the internal chamber 58 within the flinger 30. The chamber 58 accumulates pressurized fluid that flows through the opening 56 to create a source of hydraulic pressure for actuating the impact member 48.

The impact member 48 moves in response to the accumulation of pressurized fluid in a generally axial direction. The impact member 48 is positioned in contact with the collet 46 so that the movement of the impact member 48 moves the collet 46 in a longitudinal and radial direction. Preferably, the impact member 48 is a piston or plunger.

The incorporation of a lubrication system within the flinger 30 eliminates the need for a separate hydraulic system within the internal cavity 38 and provides a more compact tool assembly. The internal cavity 38 includes a pinion 60, a ring gear 62, and a bearing spacer 64. The ring gear 62 is adjacent to the shaft 26. The pinion 60, the ring gear 62, and the bearing spacer 64 are arranged in predetermined manner to reduce the overall height of the drill assembly 10. The positioning of the ring gear 62 also allows a separate motor (not shown) to be positioned outside of the drill assembly 10, which provides additional clearance for drilling operations.

The shaft 26 includes a flange 66 for holding the ring gear 62 and the bearing spacer 64. The ring gear 62 and the bearing spacer 64 are vertically positioned between the flinger 30 and the shaft flange 66. The pinion 60, the ring gear 62, and the bearing spacer 64 are horizontally positioned between the shaft 26 and the box 24.

The box 24 also includes an improved sealing device 68 rotatably connecting the shaft 26 to the box 24. The sealing device 68 is positioned adjacent to a shoulder 70 to seal the connection between the shaft 26 to the box 24. The sealing device 68 includes a plurality of o-rings 72, 74 to form a running seal between the lower portion 20 and the upper portion 22 of the drill housing 18.

As illustrated in FIG. 1, the box 24 also includes an upwardly projecting member 76 that threadedly connects to a chrome insert 78. The chrome insert 78 is axially positioned within the cavity 38 to extend through an opening 80 into the shaft 22. The insert 78 includes an internal bore 82. The bore 82 is in fluid communication with a passageway 84 formed in the box 24. The passageway 84 functions as a gland by transferring lubricant or coolant from a source (not shown) to the bore 82. The bore 82 transfers the lubricant or coolant to the drilling devices 12, 14, 16 shown in FIGS. 2-4.

Referring now to FIG. 2, the drill assembly 10 is shown with a drill steel 12 inserted therein. The drill steel 12 includes an upper section 88 and a lower section 90. In one embodiment, the lower section 90 is hexagonal.

The drill steel 12 is inserted through an opening 86 in the flinger 30 into the internal cavity 38. The collet 46 cooperates with the flinger 30, the shaft 26, impact member 48, and the resilient member 50 to grip the drill steel 12. The collet 46 includes a tubular member having an internal mating surface 94 for frictionally engaging and gripping the lower section outer surface 92 of the drill steel 12. Preferably, the internal surface 94 includes a contour that corresponds with the outer drill steel surface 92.

The drill steel lower section 90 is inserted in an essentially vertical direction through the opening 86 until the outer surface 92 of the drill steel contacts the collet 46. The collet 46 is initially biased in an upward direction due to the resilient member 50. The insertion of the drill steel lower section 90 into the opening 86 forces the collet 46 to move in a vertical direction after the lower section outer surface 92 abuts the collet internal surface 94.

The resilient member 50 in one embodiment is a Belleville spring positioned on the shaft shoulder 70. The resilient member 50 applies a biasing force to the collet 46 to maintain the collet 46 in the upwardly biased position in the drill chuck 44. In this position, the drill steel 12 is freely movable into and out of the drill head assembly 10.

When the flinger internal chamber 58 is pressurized, a force is applied through the impact member 48 to the collet 46 to overcome the upward force applied by the Belleville spring 50. The collet 46 also frictionally engages a housing 96 that is fixedly attached to the shaft 26. The housing 96 includes a tapered surface 98 that abuts a tapered external surface 100 on the collet 46.

The housing tapered surface 98 includes a contour that corresponds with a collet external surface 100. The corresponding tapers of the two surfaces 98, 100 facilitate reciprocal, longitudinal and radial movement of the collet 46 within the shaft 26. In this manner, the collet 46 moves longitudinally downwardly and grips the drill steel 12.

Referring now to FIG. 3, the drill assembly 10 is shown with a bolt driver generally designated by the numeral 14 inserted therein. The drill assembly 10 receives the bolt driver 14 through the flinger opening 86. The bolt driver 14 includes an upper section 102 and a lower section 104. The lower section 104 is essentially identical to the drill steel lower section 90 shown in FIG. 2.

The lower section 104 is inserted into the axially mounted collet 46 positioned for reciprocal movement within the shaft 26. The collet mating surface 94 frictionally engages an outer surface 106 on the bolt driver lower section 104. Once the lower section 104 has been inserted into the collet 46, fluid is injected into the flinger internal chamber 58 to move the collet 46 downwardly in an axial direction to grip the outer surface 106.

The bolt driver lower section 104 includes a tapered end portion that abuts the insert 78 after insertion. The insert 78 includes a threaded surface 108 that threadedly connects the insert 78 to the upwardly projecting member 76. The lower end portion of the bolt driver 14 engages the sealing means 68 so that the internal cavity 38 is effectively sealed from fluids from the chamber 58.

Figure 5:
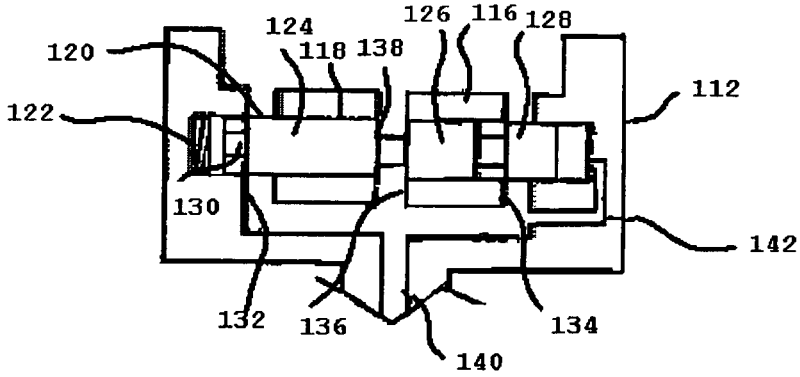
FIG. 5 is a fragmentary view in side elevation of the water distributor shown in FIG. 4 illustrated in an open position.

Referring now to FIGS. 4-5, there is shown the drill head assembly 10 in combination with the adaptor generally designated by the numeral 16. The adaptor 16 functions as a water distributor in the installation of roof bolts and rock anchor assemblies, such as the OneStep™ self-drilling rock anchor sold by the Hilti Corporation. The adaptor 16 includes an upper section 112, a lower section 114, and a spool valve 116 positioned within the upper section 112. The lower section 114 is essentially identical to the lower sections 90, 104 shown in FIGS. 2-3.

The spool valve 116 includes a horizontal bore 118 that holds a gate mechanism 120 for moving the valve 114 from a closed position shown in FIG. 4 to an open position shown in FIG. 5. In the closed position, low pressure fluids, preferably water-based lubricants or coolants, are distributed along the sides of a rock anchor (not shown) during the drilling step in the rock anchor installation. In the open position, high pressure fluids, preferably water-based, are directed into a center bore in the rock anchor (not shown) to inject resin or resin cartridges (not shown) into the upper portion of the rock anchor (not shown).

The gate mechanism 120 includes a resilient member 122 and three slidable members 124, 126, 128. The slidable members 124, 126, 128 are mounted on a rod 130 within the bore 120. The resilient member 122 applies a biasing force on the slidable members 124, 126, 128 so that a pair of side ducts 132, 134 remains open when the gate mechanism 120 is in the closed position. The slidable member 124 closes a center duct 136 in the closed position.

The slidable members 124, 126 are mounted on the rod 130 at a predetermined distance to define a gap 138 that corresponds to the width of the center duct 136. In the closed position, the gap 138 is positioned between the center duct 136 and the side duct 134. In the open position as shown in FIG. 5, the gap 138 is aligned with center duct 136 so that fluid flows therethrough. The slidable members 124, 128 close the side ducts 132, 134 in the open position.

The spool valve 116 receives fluid from the passageway 84 through a central passageway 140 in the adaptor lower section 114. The central passageway 140 trifurcates to form the ducts 132, 134, 136 in the adaptor upper section 112. At low pressure, fluid flows through the ducts 132, 134 to cool or to lubricate the rock anchor (not shown).

The passageway 140 also directs fluid into a bypass chamber 142 that is adjacent to the slidable member 128. At high pressures, fluid accumulates in the bypass chamber 142 to overcome the biasing force of the resilient member 122. The pressure forces the slidable members 124, 128 to move in a horizontal direction to close the ducts 132, 134. The pressure also aligns the gap 138 with the center duct 136 so that high pressure fluid flows into the center of the rock anchor (not shown) directing a resin cartridge (not shown) in an essentially upward direction to install the roof anchor.

Figure 6:
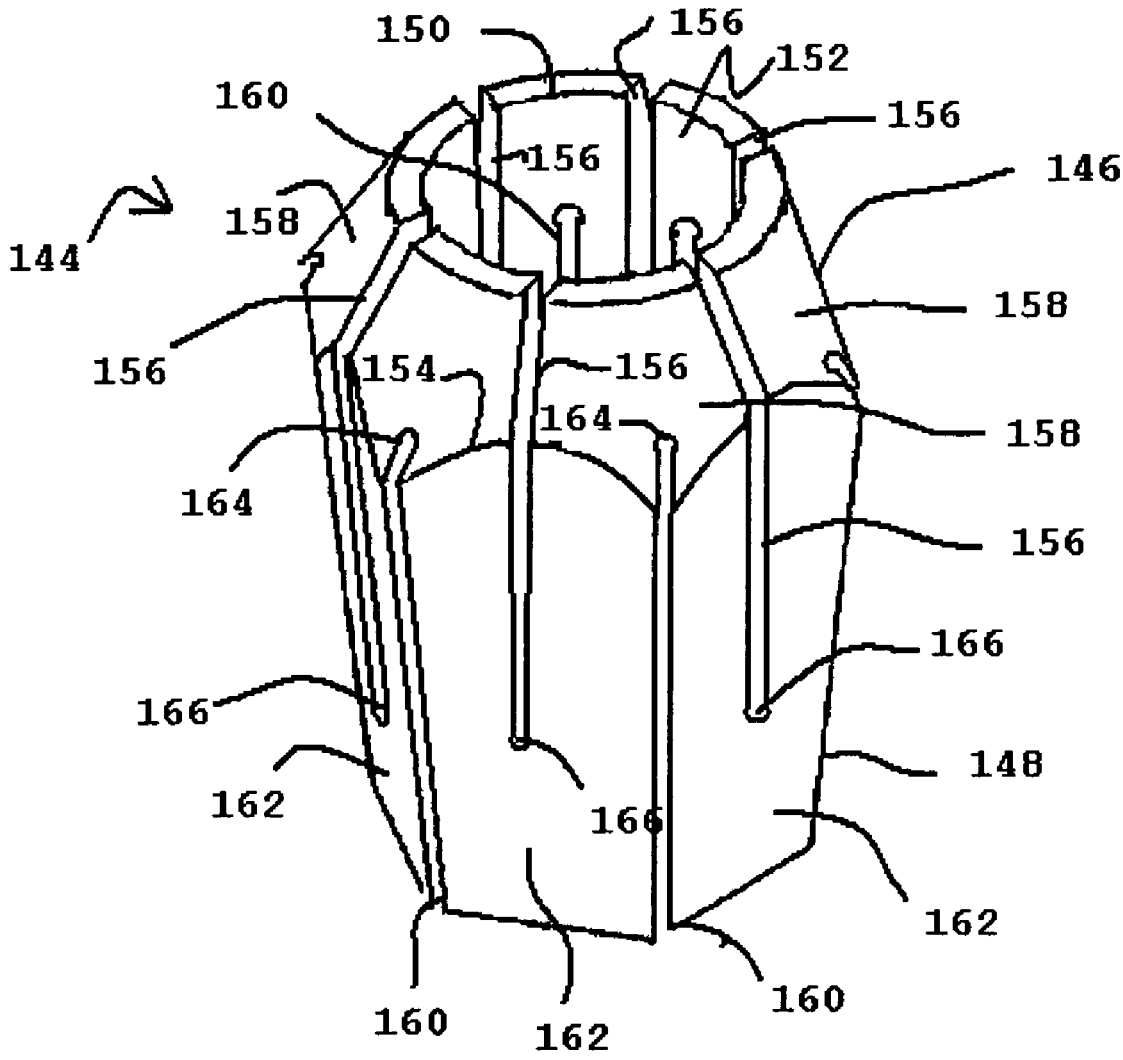
FIG. 6 is an isometric view of a collet for receiving a selected drilling device in the drill head assembly.

Referring now to FIG. 6, there is shown another embodiment of a collet generally designated by the numeral 144. The collet 144 includes an upper portion 146 and a lower portion 148. The upper portion 146 also includes a circular center bore 150 that extends along the vertical axis through the lower portion 148. The center bore 150 forms an internal surface 152 to surround and grip a drill steel (not shown) uniformly.

The lower portion 148 includes a polygonal external outer configuration, such as a hexagon as shown in FIG. 6, that is tapered along the vertical axis. The upper portion 146 includes an essentially circular outer configuration that is also tapered along the vertical axis so that the upper portion 146 and the lower portion 148 have a maximum outer diameter at their intersection 154.

The collet 144 shown in FIG. 6 is a split collet because it includes a plurality of vertical slots 156 that extend from the upper portion 146 to the lower portion 148. The slots 156 define a plurality of faces 158 on the outer surface of the upper portion 146. The slots 156 provide flexibility in the collet 144 to facilitate gripping of the drill steel by the internal surface 152.

The collet 144 also includes a plurality of vertical slots 160 that extend from the lower portion 148 to the upper portion 146. The slots 160 define a plurality of faces 162 on the outer surface of the lower portion 148. The slots 160 also provide flexibility in the collet 144 to facilitate gripping of the drill steel.

The collet 144 is formed from conventional tooling materials through conventional manufacturing methods. In one method of manufacture, the slots 156 are formed by drilling a bore 164 in each face 158 and removing material through conventional machining methods from the upper portion 146 to the lower portion 148. Similarly, the slots 160 are formed by drilling a bore 166 in each face 162 and removing material through conventional machining methods from the lower portion 148 to the upper portion 146.

According to the provisions of the patent statutes, I have explained the principle, preferred construction and mode of operation of my invention and have illustrated and described what I now consider to represent its best embodiments. However, it should be understood that, within the scope of the appended claims, the invention may be practiced otherwise than as specifically illustrated and described.

I claim:

1. A drill head assembly for holding a drilling device comprising:

a drill housing assembly having an upper portion and a lower portion with an internal cavity extending through said upper portion into said lower portion, said drill housing assembly upper portion having an opening for receiving pressurized fluid and a passageway for transporting the pressurized fluid, a sleeve having an internal surface for receiving the drilling device mounted for longitudinal and radial movement within said internal cavity, an impact member positioned in contact with said sleeve and communicating with said drill housing assembly upper portion passageway, and said drill housing assembly upper portion receiving pressurized fluid to move said impact member to displace said sleeve in an axial direction so that said sleeve internal surface frictionally engages said drilling device.

2. A drill head assembly as set forth in claim 1 which includes:

said drill housing assembly upper portion having a flinger, and said opening and said passageway being positioned in said flinger.

3. A drill head assembly as set forth in claim 1 which includes:

means for sealing and retaining the drilling device.

4. A drill head assembly as set forth in claim 1 in which:

said impact member includes a piston mounted for movement in an axial direction within said drill housing assembly upper portion.

5. A drill head assembly as set forth in claim 1 which includes:

an adaptor for distributing fluids in a rock anchor.

6. A drill head assembly as set forth in claim 1 which includes:

said drill housing assembly having a tubular shaft, said tubular shaft having a shoulder, and a resilient member being mounted on said shaft shoulder in contact with said sleeve to facilitate axial reciprocal movement of said sleeve within said shaft.

7. A drill head assembly as set forth in claim 6 in which:

said resilient member includes a Belleville spring.

8. A drill head assembly as set forth in claim 1 in which:

said sleeve internal surface defines a gripping surface tapered to receive the drilling device.

9. A drill head assembly as set forth in claim 1 which includes:

means for rotatably connecting said drill housing assembly upper portion to said drill housing assembly lower portion.

10. A drill head assembly as set forth in claim 1 which includes:

said sleeve being a split collet.

11. A drill head assembly for holding a drilling device comprising:

a housing, a shaft rotatably supported within said housing, said shaft having an internal bore with an opening for receiving the drilling device at one end of the housing, sealing means for sealing said rotating shaft at the opposite end of said housing, a gripping assembly mounted on said shaft adjacent to said opening, and said gripping assembly having a gripping member axially positioned within said bore, an impact member engaging said gripping member, and means for supplying pressurized fluid to move said impact member to displace said gripping member in an axial direction to frictionally engage the drilling device within said shaft internal bore.

12. A drill head assembly as set forth in claim 11 in which:

said gripping assembly includes a flinger for sealing and retaining the drilling device within said shaft internal bore.

13. A drill head assembly as set forth in claim 11 in which:

said gripping assembly includes a resilient member mounted within said shaft internal bore, and said resilient member engaging said gripping member to facilitate axial reciprocal movement of said gripping member within said shaft internal bore.

14. A drill head assembly as set forth in claim 13 in which:

said resilient member includes a Belleville spring.

15. A drill head assembly as set forth in claim 11 which includes:

a ring gear mounted on said shaft, and said ring gear being positioned adjacent to said sealing means.

16. A drill head assembly as set forth in claim 15 which includes:

a fluid distributor movable between a closed position at low pressures and an open position at high pressures, said fluid distributor providing fluid to a rock anchor outer surface in the closed position, and said fluid distributor injecting fluid into a rock anchor inner chamber in the open position.

17. A drill head assembly as set forth in claim 11 in which:

said housing has an internal opening and a passageway communicating with said opening, and said passageway transporting a second pressurized fluid to said opening.

18. A drill head assembly as set forth in claim 11 in which:

said gripping member includes a split collet.

19. A method for gripping a drilling device comprising the steps of:

inserting a drilling device into an axially mounted collet positioned for reciprocal movement in a shaft assembly internal bore, injecting pressurized fluid into the shaft assembly to move a piston positioned adjacent to and in contact with the collet, moving the collet in response to movement of the piston to displace the collet in longitudinal and radial directions within the shaft assembly internal bore, and nonrotatably engaging the collet with the drilling device.

20. A method as set forth in claim 19 which includes:

rotatably mounting the shaft assembly on a housing.

21. A method as set forth in claim 20 which includes:

sealing the shaft assembly within the housing.

22. A method as set forth in claim 19 which includes:

injecting a second pressurized liquid into the shaft assembly from the housing.

23. A method as set forth in claim 22 which includes:

moving a split collet into contact with the drilling device, and gripping the drilling device with the split collet.

* * * * *